United States Patent [19]

Diaz et al.

[11] Patent Number: 4,990,426

[45] Date of Patent: Feb. 5, 1991

[54] DI- AND TRICATIONIC NEGATIVE CHARGE CONTROL AGENTS FOR ELECTROPHOTOGRAPHIC DEVELOPERS

[75] Inventors: Arthur F. Diaz, San Jose; Adolfo R. Gutierrez, Gilroy; Dennis R. McKean, Cupertino, all of Calif.

[73] Assignee: International Business Machines Corporation, Armonk, N.Y.

[21] Appl. No.: 463,564

[22] Filed: Jan. 11, 1990

[51] Int. Cl.[5] ..... G03G 9/08

[52] U.S. Cl. ..... 430/110; 430/115

[58] Field of Search ..... 430/110, 115

[56] References Cited

U.S. PATENT DOCUMENTS

| | | | |
|---|---|---|---|
| 3,850,642 | 11/1974 | Bailey et al. | 430/110 X |
| 3,893,935 | 7/1975 | Jadwin et al. | 252/62.1 |
| 4,079,014 | 3/1978 | Burness et al. | 252/62.1 P |
| 4,206,064 | 6/1980 | Kiuchi et al. | 430/106 |
| 4,411,974 | 10/1983 | Lu et al. | 430/106 |
| 4,415,646 | 11/1983 | Gruber et al. | 430/110 |
| 4,433,040 | 2/1984 | Niimura et al. | 430/109 |
| 4,623,606 | 11/1986 | Ciccarelli | 430/110 |
| 4,624,907 | 11/1986 | Niimura et al. | 430/106 |

*Primary Examiner*—David Welsh

*Attorney, Agent, or Firm*—Ratner & Prestia

[57] ABSTRACT

A negative charge control agent in which the cation of the negative charge control agent is a diammonium or triammonium cation has been found to provide improved charging capacity, along with increased resin compatibility when used in toner compositions.

17 Claims, No Drawings

DI- AND TRICATIONIC NEGATIVE CHARGE CONTROL AGENTS FOR ELECTROPHOTOGRAPHIC DEVELOPERS

BACKGROUND OF THE INVENTION

1. Field of the Invention

The present invention relates to a dry-type developer material for developing latent electrostatic images to visible images, for use in electrophotography, electrostatic recording methods and electrostatic printing methods.

2. Description of Related Art

Developer material compositions containing charge-enhancing additives are known in the prior art, particularly those developers containing charge-enhancing additives which impart a positive charge to the toner resin. However, few developing compositions are known in the art wherein charge-enhancing additives are employed for the purpose of imparting a negative charge to the toner resin.

U.S. Pat. No. 3,893,935 discloses use of quaternary ammonium salts as charge control agents for electrostatic toner compositions. According to this disclosure, certain quaternary ammonium salts, when incorporated into toner materials, were found to provide a toner composition exhibiting relatively high uniform and stable net toner charge when mixed with a suitable carrier.

U.S. Pat. No. 4,079,014 contains a similar teaching with the exception that a different charge control agent is used, namely a diazo-type compound.

U.S. Pat. No. 4,411,974 discloses negatively charged toner compositions comprised of resin particles, pigment particles, and as a charge-enhancing additive, ortho-halo phenyl carboxylic acids.

U.S. Pat. No. 4,206,064 discloses toner compositions which are chromium, cobalt and nickel complexes of salicylic acid, as negative charge-enhancing additives.

U.S. Pat. No. 4,415,646 discloses a polymeric charge-enhancing additive resulting from the condensation reaction of maleic anhydride polymers with certain alkyl diamines, followed by quaternizing the resulting product.

U.S. Pat. No. 4,623,606 discloses a toner composition comprised of resin particles, pigment particles and iron complex charge-enhancing additives. Among the cations said to be useful with the iron complex charge-enhancing additives were hydrogen, sodium, potassium, ammonium, substituted ammonium, including aliphatic, alicyclic and heterocyclic ammonium.

U.S. Pat. No. 4,433,040 discloses an electrophotographic toner containing a metal complex die in which the metal complex contains a chromium or a cobalt atom. The metal complex die of the foregoing reference is a two-to-one type metal complex die with the negative charge neutralized by a cationic moiety, specifically by a hydrogen atom. The materials of this reference were alleged to exhibit remarkably high compatibility with the binder resin.

U.S Pat. No. 4,624,907 further discloses a charge-controlling and coloring agent comprising a two-to-one type metal complex die similar to that of the U.S. Pat. No.4,433,040. However, in the subject disclosure, the cationic material is an ammonium ion, an aliphatic ammonium ion, an alicyclic ammonium ion, or a heterocyclic ammonium ion, while the metal is a chromium, cobalt or iron atom.

Although the aforementioned references, the disclosures of which are incorporated by reference herein, provide outstanding performance as negative charge control agents, there remains a need for materials which have substantially improved compatibility with resin formulations, as well as exhibiting superior triboelectric properties.

It is, therefore, an object of this invention to provide a superior charge control agent which has an optimum combination of charging capacity and compatibility with binder resin.

Many of the negative charge control agents described in the literature are salts of a large negative anion, wherein the negative charge is diffused over numerous atoms, and a countercation, such as hydrogen, ammonium, lithium, sodium or potassium. Since the mechanism of charging is not well understood, the discovery and exploitation of new negative charge control agents is extremely difficult. The art has focused upon attempts to modify or uncover new anionic materials as charge control agents. It has now been discovered, however, that modification of the cationic portion of the agent will provide significantly enhanced performance in toner compositions.

SUMMARY OF THE INVENTION

A negative charge control agent for use in toner compositions in which the cation of the negative charge control agent is a diammonium or a triammonium cation which provides improved charging capacity, along with increased resin compatibility, in mono and dual component toner compositions.

DETAILED DESCRIPTION OF THE INVENTION

This invention provides a dry-type developer material comprising toner particles capable of being negatively charged sufficiently for practical use. The electrophotographic toner of the present invention comprises a binder resin, a specific charge controlling agent and, optionally a coloring agent.

The binder resin is generally a polymeric resin, such as polystyrene, acrylic resin, polyvinyl chloride, polyvinyl acetate, epoxy resin, alkyd resin, polyethylene, phenolic resin, butyral resin, polyester resin, xylene resin and polyamide resin.

As used herein, the term "ammonium" refers to cations of general formula $R_4N^+$ in which the positively charged species contains a nitrogen atom and from 0 to 3 hydrogen atoms, including aliphatic, alicyclic, and heterocyclic compounds.

The cationic counterions which have been found to be useful in this invention include aliphatic and alicyclic diammonium dications, including those with heteroatoms, such as nitrogen, oxygen or sulfur, in the alkyl chain or ring, as shown below. In the following structures, "X" is the anion of a salt having charge control properties, such as are disclosed in the aforementioned patents, the disclosures of which are incorporated by reference herein.

$$\underset{X^-}{NH_3^+}-(CH_2)_x-\underset{X^-}{NH_3^+}$$

Further materials of use in this invention are disubstituted arylene-linked diammonium cations, including naphthalene-linked species, with various heteroatoms such as nitrogen, oxygen or sulfur, in the chain, as shown below.

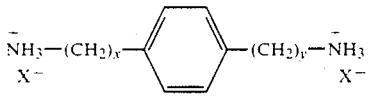

In addition, amine end-capped epoxy resins,

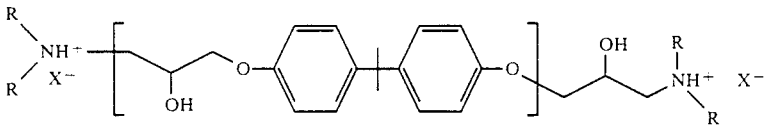

amine end-capped polyester resins,

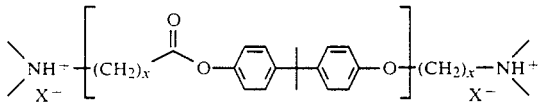

tricyclohydrocarbon-linked diammonium cations,

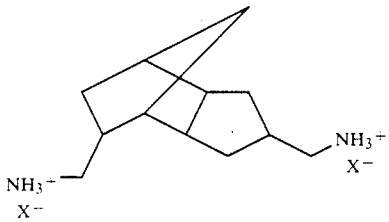

triammonium cations and trisubstituted arene-linked triammonium cations

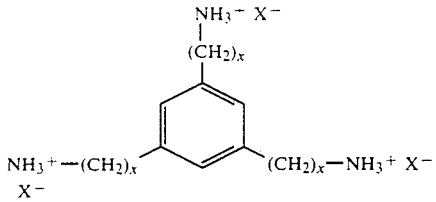

are useful in this invention.

Further, triammonium end-capped epoxy cations, namely epoxy resins with three or four epoxide N-groups end-capped with organic amines are suitable counterions for this invention.

The electrophotographic toner of the present invention can be prepared in the following manner. A suitable anionic metal complex is mixed with the binder resin in the form of a melt. Typically, the resin is 80–90 wt % of the composition, the charge control agent is approximately from about 0.2 wt % to about 5.0 wt %, and the remainder is carbon black, or color dyes or pigments, and other additives. The solidified mixture is converted into fine toner particles, about 10μ in diameter by using a pulverizing machine, such as a jet mill.

A preferred embodiment of this invention consists of the use of epoxy and end-capped epoxy resins. A particularly preferred embodiment is a methylanilinium end-capped epoxy dication, where an ammonium cation is present at each end of the epoxy resin. This dication will associate two negative metal complex anions.

The following examples are presented to illustrate the present invention. However, those skilled in the art will appreciate that the scope of the invention is no way limited by the specific examples set forth in detail below.

EXAMPLE 1

The compounds tested were prepared using the same anion (Hodagaya T-37 anion) and exchanging the cation. Toner was prepared by mixing 0.4 weight percent of a test compound with an end-capped epoxy resin (Epon, Shell Chemical Company), milling and sizing to 6μ particles. The toner was then mixed at the 2.5 wt % level with an iron carrier (120–200μ diameter) coated with an epoxy film. This combination was then carolled for thirty minutes to achieve a steady state charge.

The charging value, Q/M in microcoulombs/gram, was determined by the total blow-off method, where the toner/carrier mix is placed in a Faraday cage and the toner is blown away from the carrier through a wire screen (45μ opening).

The results are shown in the following table, along with the weight percent solubility of the toner in the resin.:

| Cation | Q/M (μc/g) | Solubility (wt. %) |
|---|---|---|
| No agent | 33, 45 | N/A |
| Ammonium | +19 | 0.7 |
| Ammonium (5 wt. %) | −21 | 0.7 |
| Dodecyldiammonium | −56 | 3.3 ± 0.2 |
| Methylanilinium Epon | −7 | (high) |

In the absence of a charge control agent, the charging value is highly positive and quite unstable. Typically, the absence of a charge control agent leads to a highly charge sensitive toner composition.

The ammonium counterion provides the desired negative charging value only when used at high levels, such as 5 wt %. At the more commonly used lower levels, ammonium is ineffective as a cation in negative charge control agents.

The charging level of the compound with the dodecyldiammonium dication is considerably higher than with the ammonium cation. In addition, the dodecyldiammonium compound exhibits superior solubility to the ammonium material. The solubility is a critical parameter for an acceptable charge control agent. With high solubility, there is increased compatibility of the additive and the resin. The methylanilinium-capped Epon also provides high solubility and a negative charging value.

That the use of diammonium and triammonium cations would lead to such significant changes in the charging ability and solubility of the toner materials was completely unexpected. This effect is expected to be general for a wide variety of di- and triammonium ionic compounds having a large anion that diffuses charge over numerous atoms. This would include the anions of metal complexes, the aromatic anions, such as aromatic sulfonates and aromatic carboxylates, and other large anions which have little sensitivity to moisture.

The end-capped Epon charge control agents are expected to be most compatible in toner consisting of epoxy resins and end-capped epoxy resins, in view of the fact that the cationic material is an end-capped epoxy resin. However, they should also be highly compatible with the styrene acrylate and polyester resins used in toners.

EXAMPLE 2

In a similar manner, a commercial charge control agent having a zinc salicylate anion and an ammonium cation (Bontron E-84) was ion exchanged to form the dodecyldiammonium salt and the cyclohexyldiammonium salt. These additives were individually melt mixed with ZSR1005 resin (Polytribo Inc.) and carbon black, milled and size classified. The toner was then mixed with the iron particle carrier and the Q/M was measured as before.

| Toner Cation | Q/M (μC/g) |
|---|---|
| Bontron E-84 (control) | −12.3 |
| Dodecyldiammonium | −7.8 |
| Cyclohexyldiammonium | −9.5 |

Although this invention has been described with reference to specific embodiments, its scope is limited only by the following claims and their equivalents.

We claim:

1. A negatively charged toner composition comprising resin particles and a charge-control agent, in which said charge-control agent is a salt of a diammonium or triammonium cation and an anion selected from the group consisting of large metal complex anions and aromatic anions.

2. A toner composition of claim 1 in which the anion of the charge control agent is a metal complex anion in which said metal is iron, chromium or cobalt.

3. A composition of claim 1 in which the cation is selected from aliphatic diammonium cations, alicyclic diammonium cations, disubstituted arylene-linked diammonium cations, amine end-capped polyesters, amine end-capped epoxys, tricyclohydrocarbon-linked diammonium and triammonium cations, and trisubstituted arene-linked triammonium cations.

4. A toner composition of claim 3 in which the cation of the charge-control agent is a methylanilinium end-capped epoxy.

5. A toner composition of claim 3 in which the cation of the charge-control agent is a ($C_6$–$C_{18}$) alkyldiammonium dication.

6. A composition of claim 5 in which the cation of the charge-control agent is dodecyldiammonium.

7. A composition of claim 3 in which the cation of the charge control agent is a ($C_6$–$C_{12}$) alicyclic diammonium dication.

8. A composition of claim 7 in which the cation of the charge control agent is cyclohexyldiammonium dication.

9. A composition of claim 1 in which the charge control agent is present in an amount of from about 0.2 to about 5.0 weight percent.

10. A composition of claim 1 in which the charge control agent is present in a charge control effective amount for controlling the charge of the toner resin.

11. A composition of claim 1 in which color dyes or pigments are also present therein.

12. A composition of claim 1 in which carbon black or black dyes or pigments are also present therein.

13. A dual component developer composition comprising the toner composition of claim 1 and carrier particles.

14. A developer composition of claim 13 wherein the carrier particles are comprised of metal beads.

15. A developer composition of claim 14 in which the metal beads are coated with polymer.

16. A mono-component developer composition comprising the toner composition of claim 1.

17. A method of imaging comprising formulating an electrostatic latent image on a positively charged photoreceptor, effecting development thereof with a toner composition of claim 1, and transferring the developed image to a suitable substrate.

* * * * *